US007819701B2

(12) United States Patent
Xia et al.

(10) Patent No.: US 7,819,701 B2
(45) Date of Patent: Oct. 26, 2010

(54) ROTATABLE ELECTRICAL PLUG CONNECTOR

(75) Inventors: Yue Xue Xia, Singapore (SG); Mui Lian Jessica Toh, Singapore (SG); Chee Foo Richard Loh, Singapore (SG)

(73) Assignee: Volex Pte Ltd, Singapore (SG)

( * ) Notice: Subject to any disclaimer, the term of this patent is extended or adjusted under 35 U.S.C. 154(b) by 0 days.

(21) Appl. No.: 12/296,374

(22) PCT Filed: May 24, 2007

(86) PCT No.: PCT/SG2007/000149

§ 371 (c)(1),
(2), (4) Date: Dec. 5, 2008

(87) PCT Pub. No.: WO2008/036048

PCT Pub. Date: Mar. 27, 2008

(65) Prior Publication Data

US 2009/0186492 A1 Jul. 23, 2009

Related U.S. Application Data

(60) Provisional application No. 60/846,358, filed on Sep. 22, 2006.

(51) Int. Cl.
*H01R 25/00* (2006.01)

(52) U.S. Cl. ..... 439/640

(58) Field of Classification Search ..... 439/640, 439/173, 172, 171

See application file for complete search history.

(56) References Cited

U.S. PATENT DOCUMENTS

| | | | | |
|---|---|---|---|---|
| 6,398,566 | B1 | 6/2002 | Chen | |
| 6,494,727 | B2 * | 12/2002 | Wen-Ching | 439/131 |
| 7,125,266 | B1 * | 10/2006 | Huang | 439/131 |

FOREIGN PATENT DOCUMENTS

| | | |
|---|---|---|
| JP | 13078452 | 3/2001 |
| JP | 16095431 | 3/2004 |
| JP | 17322571 | 11/2005 |

* cited by examiner

*Primary Examiner*—Phuong K Dinh
(74) *Attorney, Agent, or Firm*—Occhiuti Rohlicek & Tsao LLP

(57) ABSTRACT

A rotatable electrical plug connector includes a main body and an auxiliary plug which is rotatably coupled to the main body. The main body is provided with fixed electrical terminals, the auxiliary plug is provided with electrical blades, and the rotatable electrical plug connector has electrical connection members connecting the electrical terminals and the electrical blades. The auxiliary plug is rotatable relative to the main body, and may be fixed to the main body at any predetermined position. At each predetermined position and during rotation of the auxiliary plug, the electrical blades and the electrical terminals are electrically connected at all times. A rotatable electrical plug connector according to embodiments of the present invention is suitable to connect to power supply is sockets at convenient engagement positions.

15 Claims, 13 Drawing Sheets

SECTION A-A

ROTATABLE ELECTRICAL PLUG CONNECTOR

CROSS-REFERENCE TO RELATED APPLICATIONS

This application is the National Stage of International Application No. PCT/SG2007/000149, filed on May 24, 2007, which claims the priority of U.S. Provisional Application No. 60/846,358, filed on Sep. 22, 2006. The contents of both applications are hereby incorporated by reference in their entirety.

TECHNICAL FIELD

The present invention relates to an electrical power connector. In particular, it relates to a rotatable electrical plug connector.

BACKGROUND OF THE INVENTION

Electrical plug connectors are used in electrical devices where external power supply is required. Conventional electrical plug connector has electrically conductive blades connected to a power cable and fixed together in a housing. When in use, the plug connector is plugged into a power supply socket, for example a wall power outlet through which, electricity can be supplied to the electrical device connected by the power cable.

Users often encounter difficulties when using the conventional electrical plug connectors, in particular when the access to wall power outlet is constraint due to limited space available, or the blockage by surrounding items such as furniture or other power cables. In such situations, in order to connect to the wall power outlet, the power cable may have to be routed around the blockage or, if not long enough, the power cable may be forced to bent to accommodate the constraint access space. This may cause poor connections to the power socket, hence the plug connector may tend to loose or disengage from the power socket, and result in power supply failure.

It is therefore desirable to provide an improved electrical plug connector which enables users to select a suitable and convenient angle of engagement with the wall power sockets, depending on the conditions of the surrounding items and space available. Unfortunately, such an electrical plug connector is currently not available.

SUMMARY OF THE INVENTION

A rotatable electrical plug connector according to embodiments of the present invention has a main body and an auxiliary plug. A first set of electrical blades is fixed to the auxiliary plug and a second set of electrical terminals is fixed to the main body.

The auxiliary plug is rotatably coupled to the main body by a pivot shaft which is electrically connected to the second set of electrical terminals.

The rotatable electrical plug connector includes connection members for electrically coupling to the first set of electrical blades and second set of electrical terminals.

The connection members are spring contact by a spring bush to the pivot shaft such that during rotation of the auxiliary plug, the first set of electrical blades and the second set of electrical terminals are electrically connected at all times and at any position.

The connection members are in contact with the side surface of the pivot shaft to provide a primary electrical connection. The connection members may also in contact with the end surface of the pivot shaft to provide a complementary electrical connection.

The rotatable electrical plug connector further includes resilient members biased to the auxiliary plug for fixing the auxiliary plug at desired positions, and to enable releasably flip of the auxiliary plug to rotate relative to the main body, and to one or other pre-determined positions.

A rotatable electrical plug connector according to embodiments of the present invention is suitable to connect to power supply sockets at convenient engagement positions. Routing or force bending of the power cable due to space constraint may be avoided. Access to power supply socket is more convenient, and power supply reliability is improved.

BRIEF DESCRIPTION OF THE DRAWINGS

These and other aspects and advantages of the present invention will be described in detail with reference to the accompanying drawings, in which.

DETAILED DESCRIPTION OF THE PREFERRED EMBODIMENTS

Figure 1A:
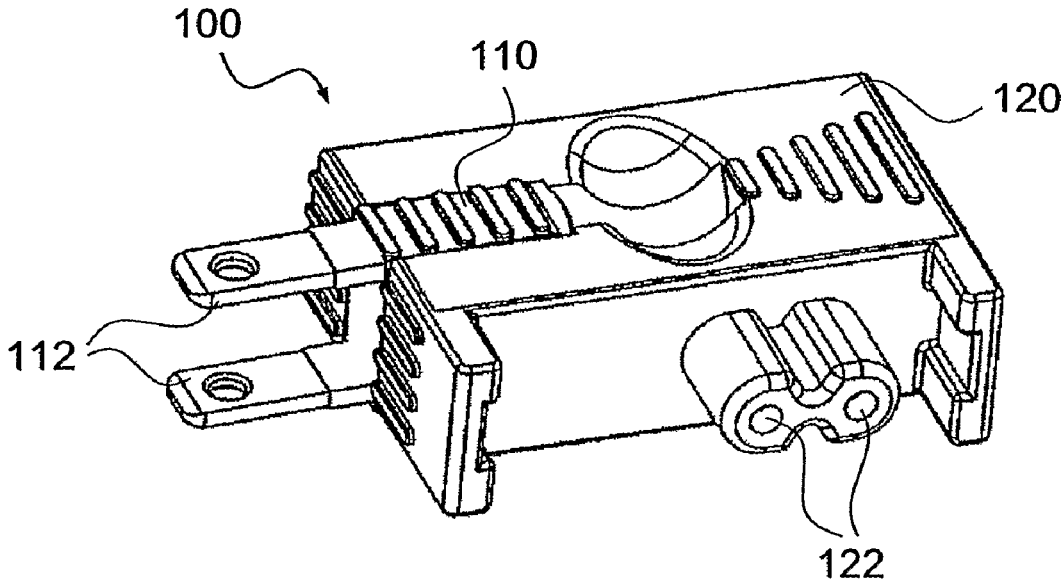
FIG. 1A is a perspective view showing a rotatable electrical plug connector according to one embodiment of the present invention, when the electrical blades are rotated facing outward.
Figure 1B:
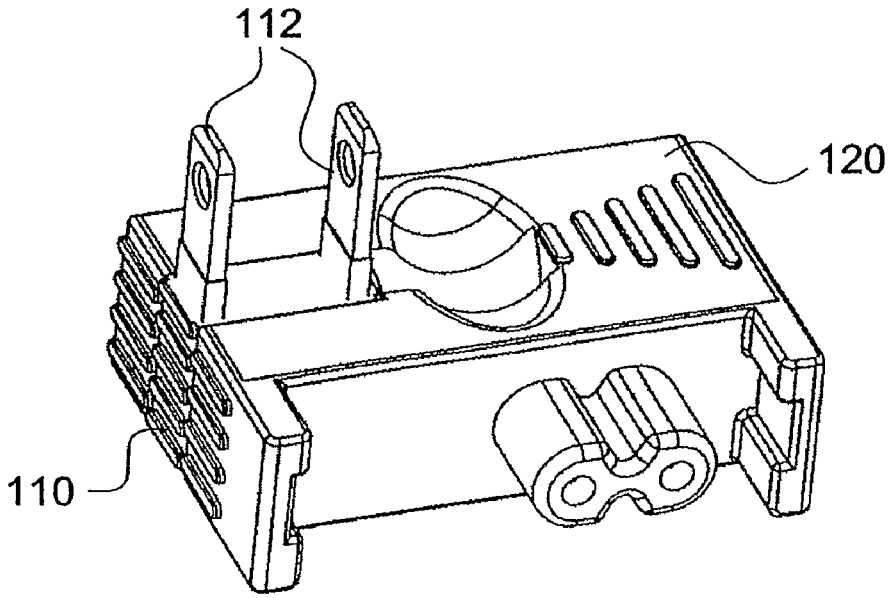
FIG. 1B is a perspective view of FIG. 1A when the electrical blades are rotated facing upward.
Figure 1C:
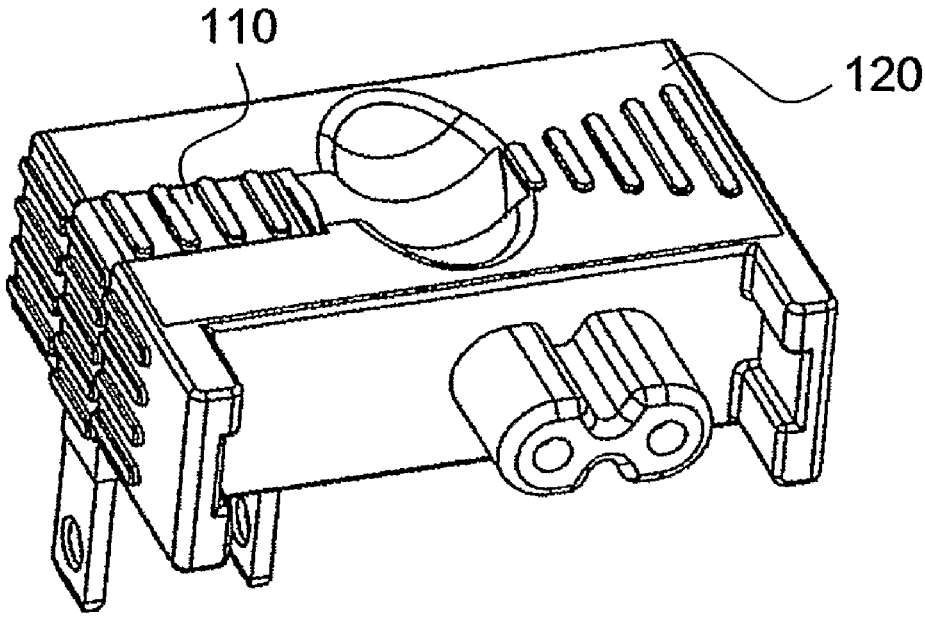
FIG. 1C is a perspective view of FIG. 1A when the electrical blades are rotated facing downward.
Figure 1D:
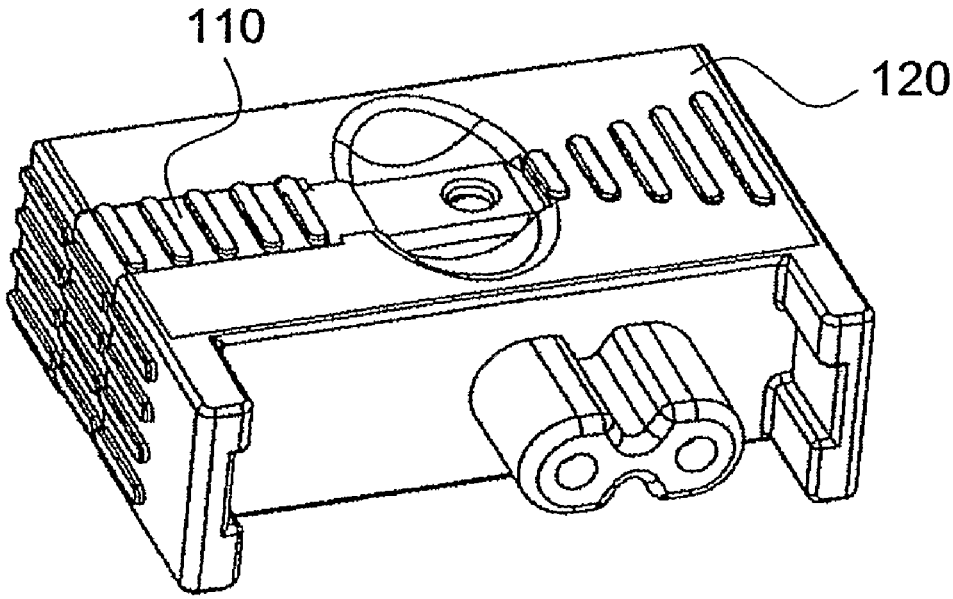
FIG. 1D is a perspective view of FIG. 1A when the electrical blades are rotated facing inward.
Figure 2A:
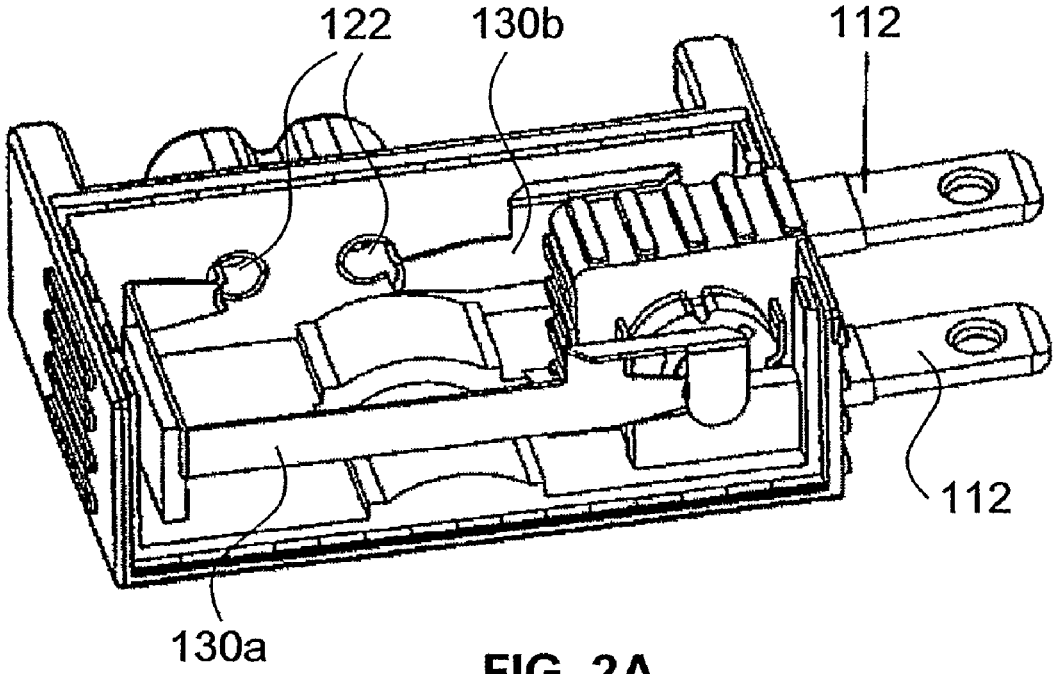
FIG. 2A is a partial perspective showing an internal structure of a rotatable electrical plug connector of FIG. 1A.
Figure 2B:
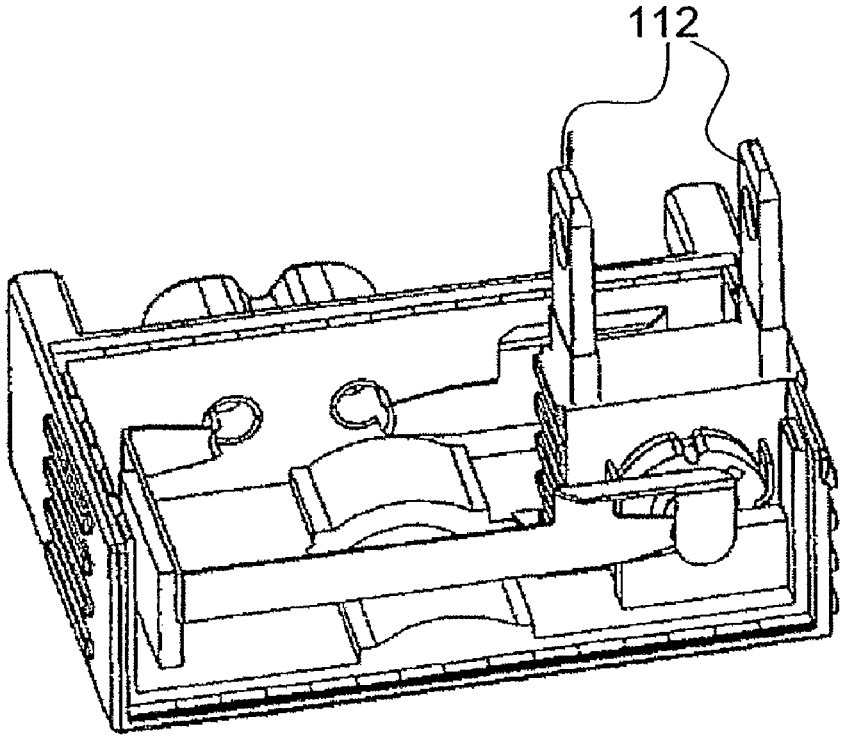
FIG. 2B is a partial perspective showing an internal structure of a rotatable electrical plug connector of FIG. 1B.
Figure 2C:
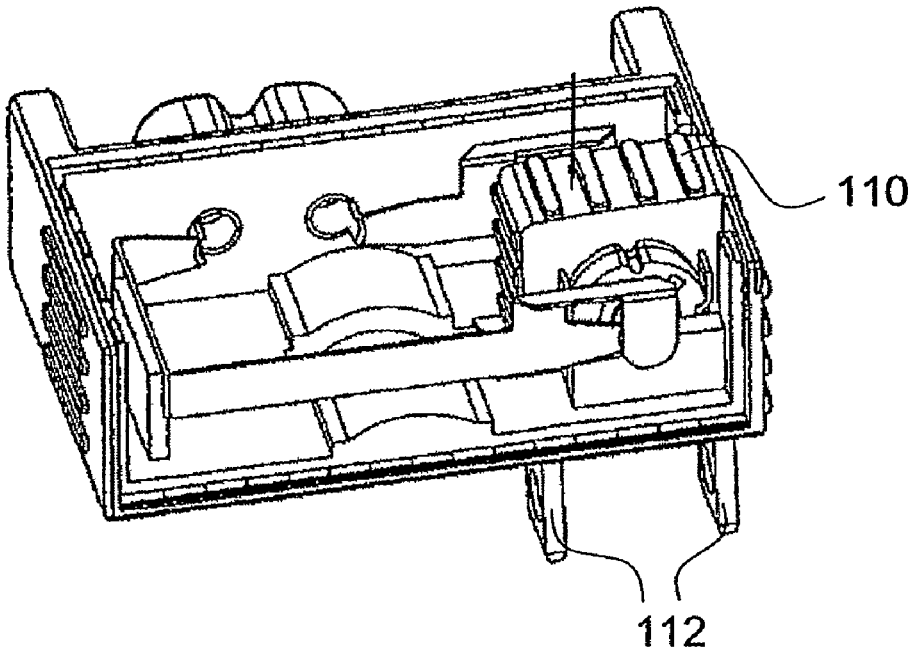
FIG. 2C is a partial perspective showing an internal structure of a rotatable electrical plug connector of FIG. 1C.
Figure 2D:
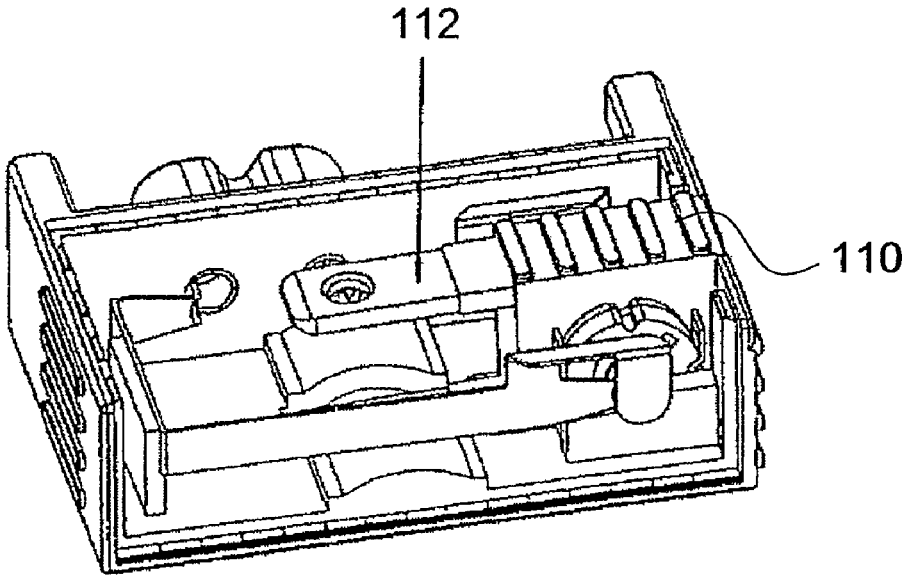
FIG. 2D is a partial perspective showing an internal structure of a rotatable electrical plug connector of FIG. 1D.

As shown in FIGS. 1A, 1B, 1C and 1D, a rotatable electrical plug connector 100 according to one embodiment of the present invention has a main body 120 and an auxiliary plug 110. A set of electrical blades 112 is fixed to the auxiliary plug 110, and a set of electrical terminals 122 is fixed to the main body 120. the electrical blades and the electrical terminals may be made of electrically conductive material, such as brass. The set of electrical terminals 122 may be configured according to industrial standards, for connecting to another electrical device for supplying electrical power thereto. The auxiliary plug 110 is rotatably coupled to the main body 120, and is rotatable relative to the main body at different positions.

As shown in FIGS. 2A, 2B, 2C and 2D, the rotatable electrical plug connector 100 includes connection members 130*a* and 130*b* for electrically coupling to the set of electrical blades 112 and set of electrical terminals 122.

Figure 3A:
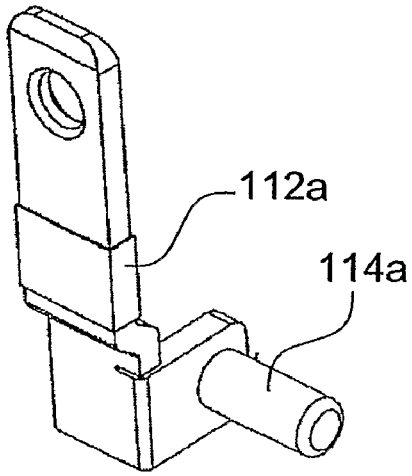
FIG. 3A is a perspective view showing an electrical blade of a rotatable electrical plug connector of FIG. 1A.
Figure 3B:
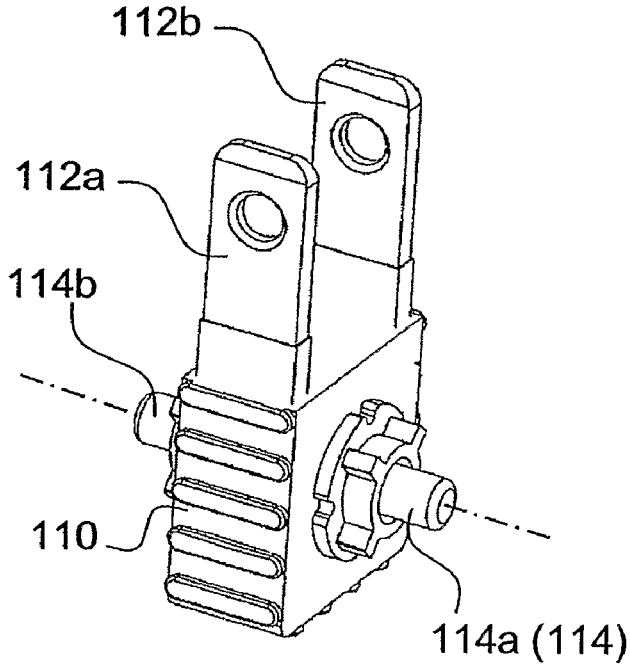
FIG. 3B is a perspective view showing two electrical blades integrated together to form an auxiliary body of the rotatable electrical plug connector shown in FIG. 1A.

One of the set of electrical blades 112, referred to as blade 112*a*, is shown in FIG. 3A. A shaft member 114*a* is formed at one end of electrical blade 112*a*. Preferably, electrical blade 112*a* and shaft member 114*a* are formed of one piece of electrical conductive material, for example, brass. In the present embodiment, the other one of the set of electrical blades 112, referred to as electrical blade 112*b* in FIG. 3B, has a same shape, dimension and material as electrical blade 112*a*. Electrical blades 112*a* and 112*b* may be fixed together by, for example, molding, with an insulating material forming the auxiliary plug 110, as shown in FIG. 3B.

Electrical blades 112*a* and 112*b* are fixed together in such a configuration that, blades 112*a* and 112*b* are positioned in a blade plane and parallel to each other forming an electrical power plug conforming to industrial standards. Shaft members 114*a* and 114*b* are axially aligned with each other, forming a pivot shaft 114 on the auxiliary plug 110. In the present embodiment, pivot shaft 114 is positioned orthogonal to the blade plane.

Figure 3C:
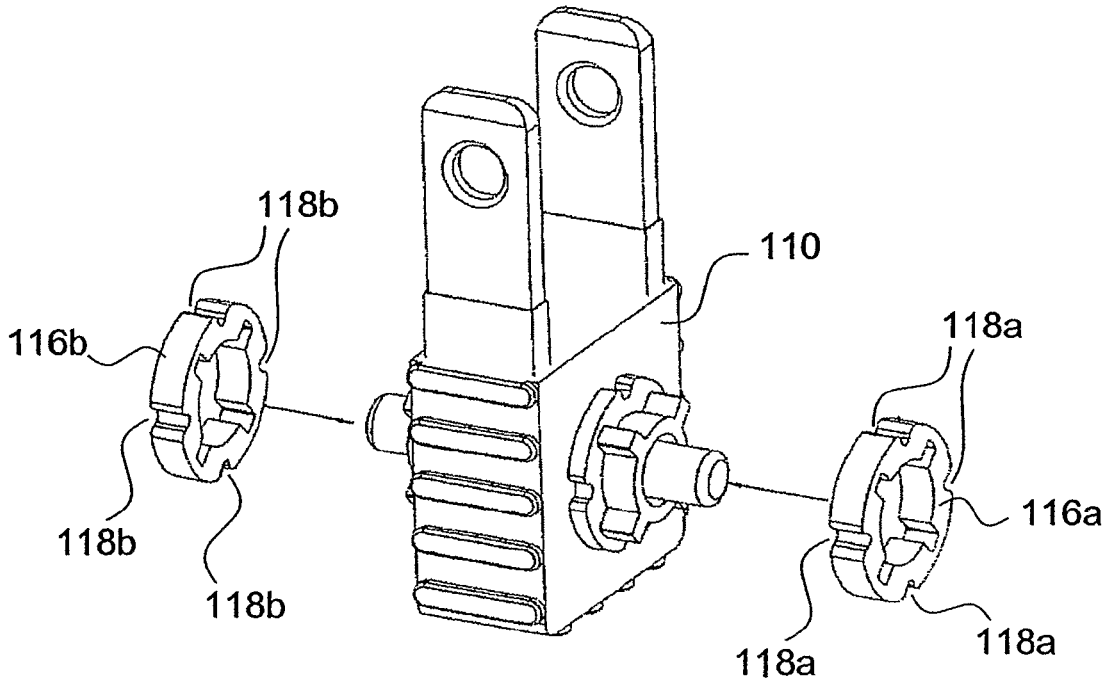
FIG. 3C is an exploded perspective view showing a position of the auxiliary body of the rotatable electrical plug connector.
Figure 3D:
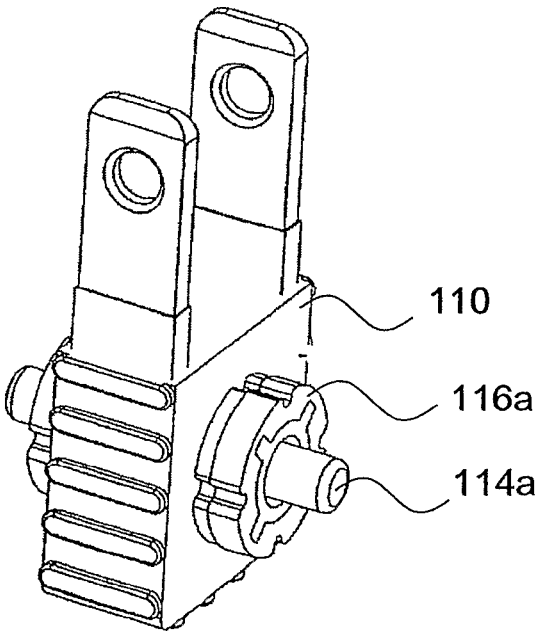
FIG. 3D is a perspective view of FIG. 3C when assembled together.
Figure 3E:
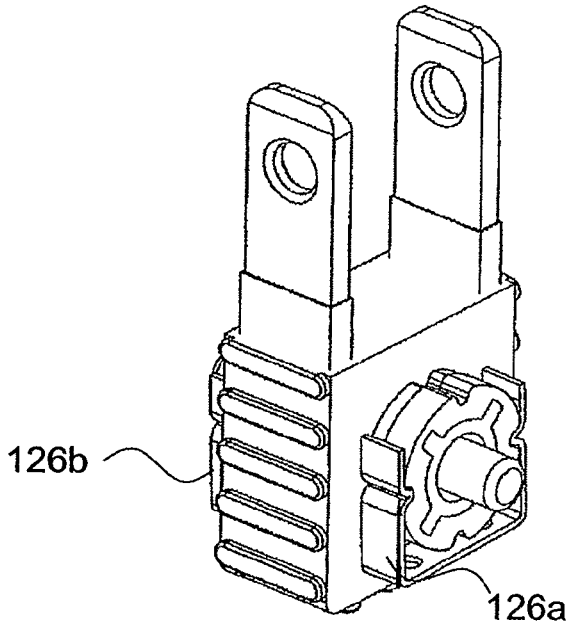
FIG. 3E is a perspective view of FIG. 3D with a spring member is assembled to the auxiliary plug.

As shown in FIGS. 3C, 3D and 3E, a pair of notched rings 116*a* and 116*b* are installed onto the auxiliary body 110, each having four notches 118*a* and 118*b* formed thereon. Notched rings 116*a* and 116*b* will be fixed to and rotate together with, the auxiliary body 110. A pair of springs 126*a* and 126*b* is biased on respective notched rings 116*a* and 116*b*. Detailed structures and functions of the springs 126*a* and 126*b* will be described below.

Figure 4A:
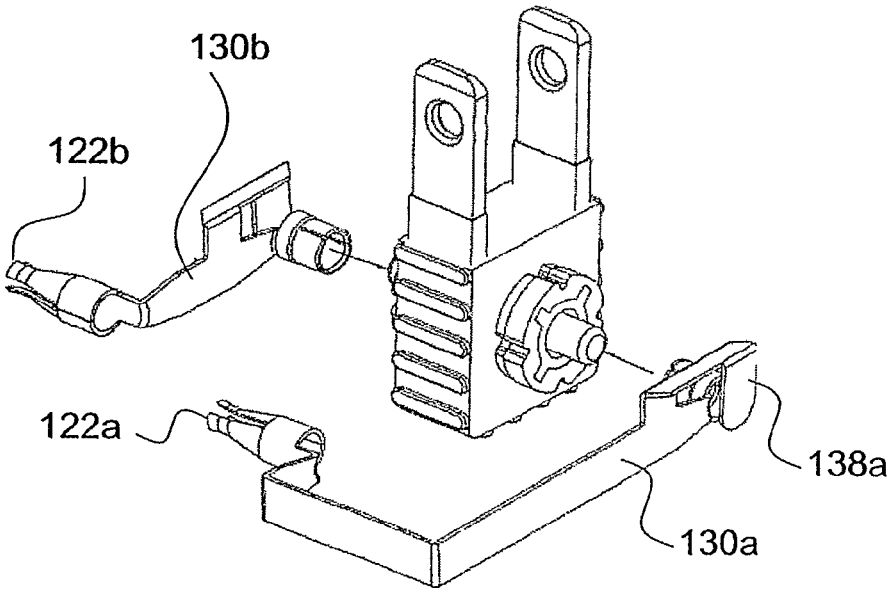
FIG. 4A is an exploded perspective showing electrical connection members and the auxiliary plug.
Figure 4B:
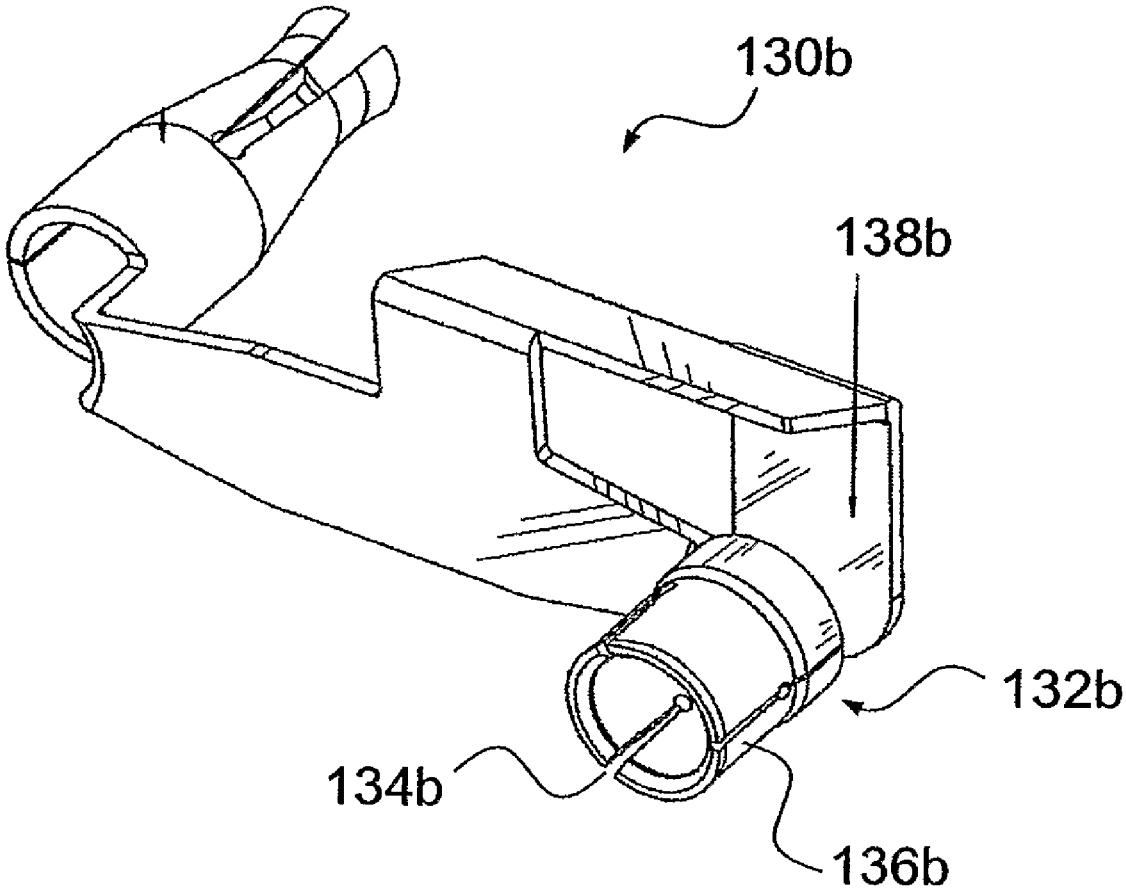
FIG. 4B is a perspective view of a first electrical connection member of the rotatable electrical plug connector.
Figure 4C:
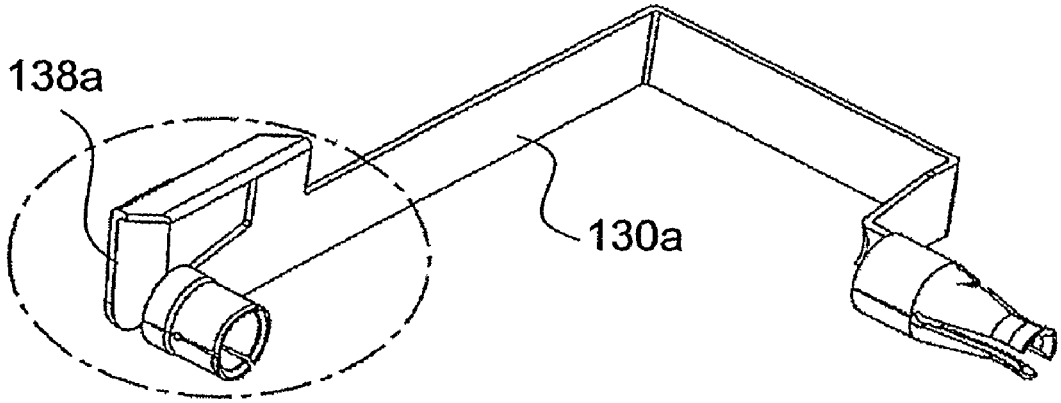
FIG. 4C is a perspective view of a second electrical connection member of the rotatable electrical plug connector.
Figure 4D:
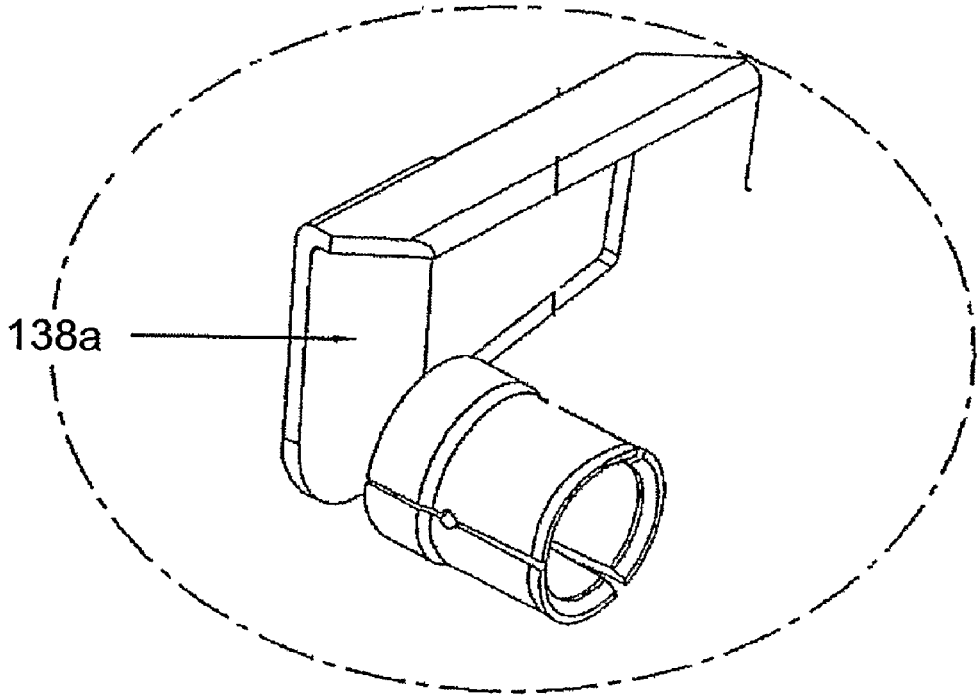
FIG. 4D is a partially enlarged view of FIG. 4C.
Figure 4E:
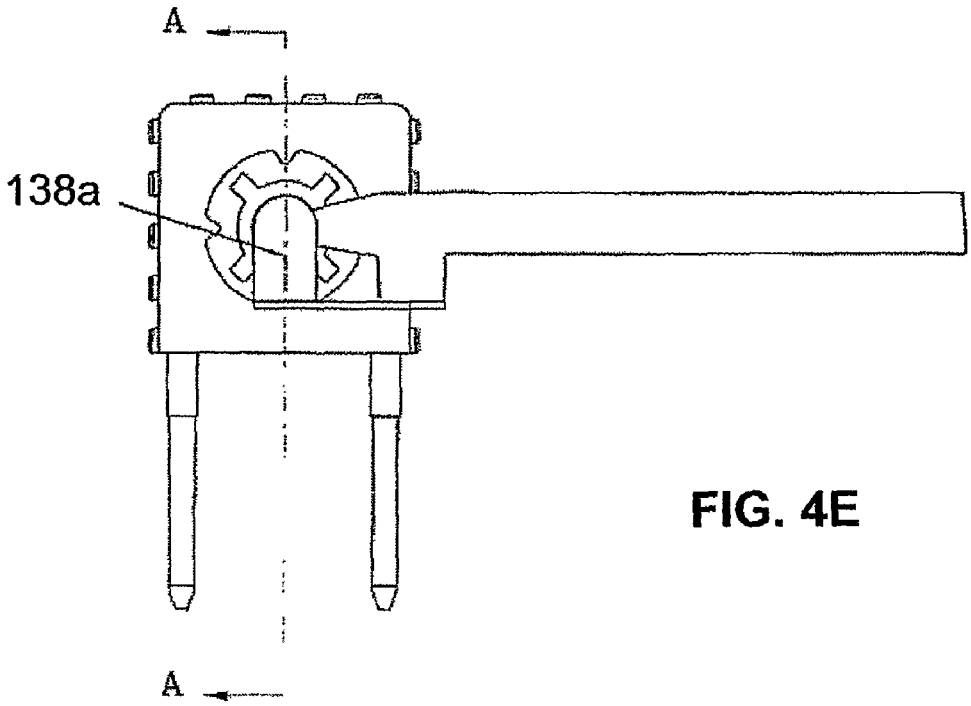
FIG. 4E is a front view showing a connection structure of the auxiliary body and an electrical connection member.
Figure 4F:
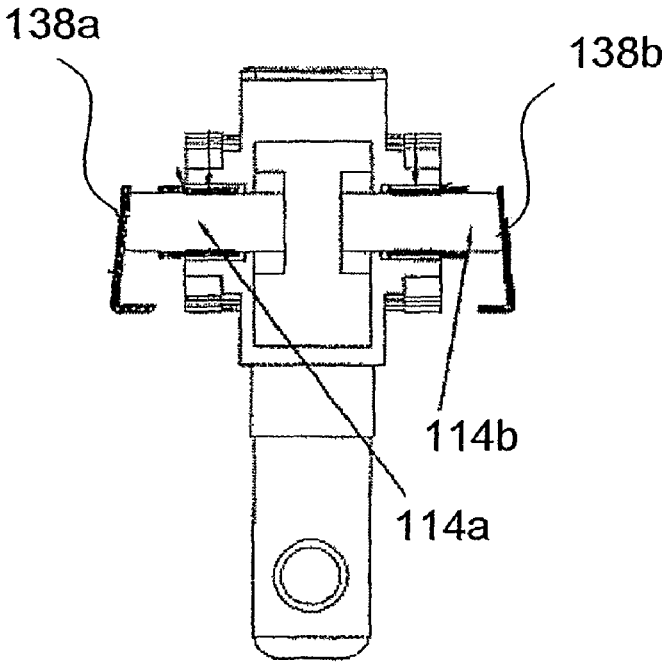
FIG. 4F is a A-A cross sectional view of FIG. 4E.

As shown in FIG. 4A, electrical connecting members 130*a* and 130*b* are provided, each for electrically connecting one electrical blade 112*a* or 112*b* to a corresponding electrical terminal 122*a* or 122*b*. One of the connecting members, e.g. connecting member 130*b* is taken as an example to illustrate its detailed structures and positional relationship with the auxiliary plug 110, as shown in FIG. 4B, Formed at one end of the connecting member 130*b* there is a spring bush 132*b*, having a bore dimension slightly smaller than the diameter of the shaft 114.

Figure 5A:
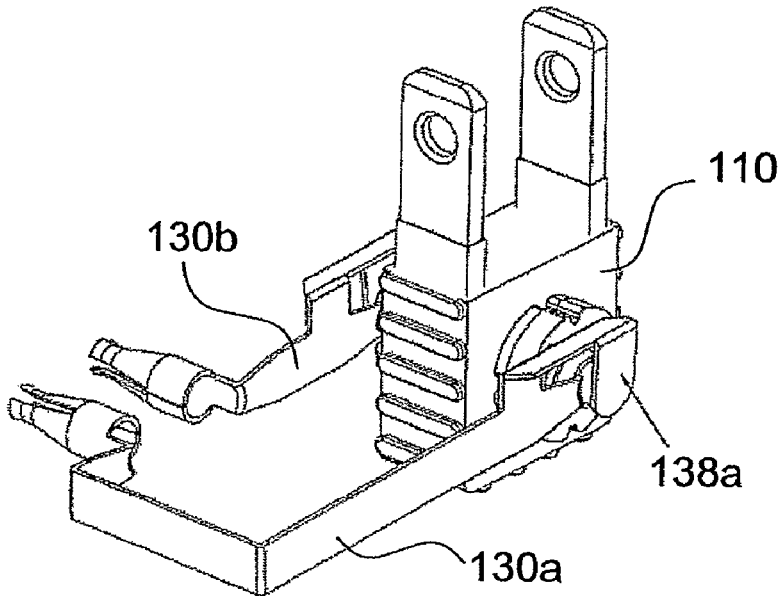
FIG. 5A is a perspective view of FIG. 4A when the electrical connection members are assembled to the auxiliary plug.
Figure 5B:
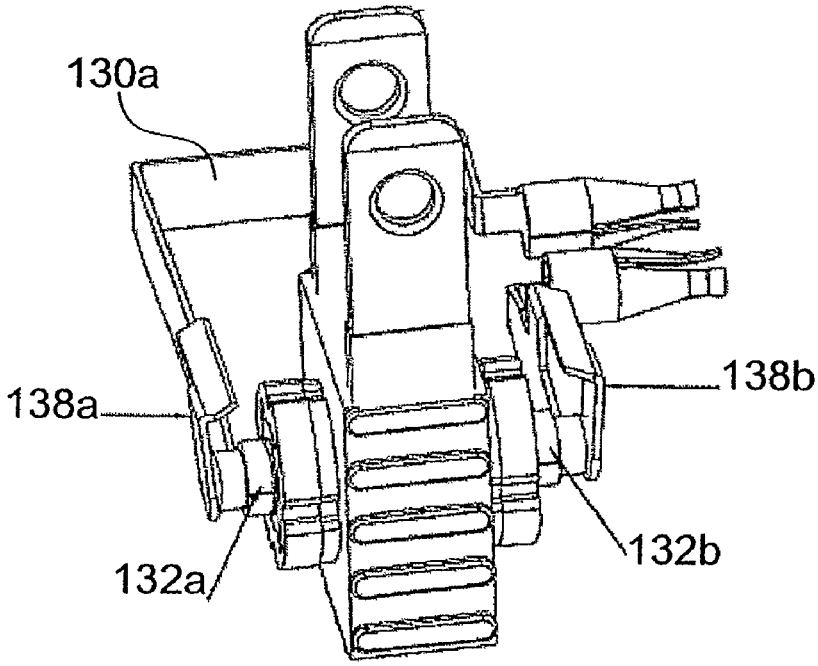
FIG. 5B is a perspective view of FIG. 5A from another viewing point.

As shown in further details in FIGS. 4B, 4C, 4D, 4E and 4F, spring bush 132*b* has a number of slits 134*b* formed on the sidewall 136*b*. The spring bush 132*b* is therefore divided by slits 134*b* into several segments along the circular direction of the spring bush 132*b*. Connecting member 130*b* and spring bush 132*b* are formed of electrically conductive and resilient material, for example alloy, such that the pivot shaft 114 can be inserted into the spring bush 132*b*, by overcoming the spring force of the spring bush 132*b*. When the pivot shaft 114 is inserted, the spring bush 132*b* is slightly deformed outwardly, resulting in a resilient force in the spring bush 132*b*. By this arrangement, the pivot shaft 114 is maintained with good contact with spring push 132*b*, hence the connecting member 130*b*. The other one of the connecting member 130*a* is structured and installed onto pivot shaft 114 in a similar manner, as shown in FIGS. 5A and 5B. When the auxiliary plug 110 is installed on connecting members 130*a* and 130*b*, spring bushes 132*a* and 132*b* also serve as a bearing to support the auxiliary plug 110 such that, the auxiliary plug 110 becomes rotatable relative to the connection members 130*a* and 130*b*. Due to the spring force of the spring bushes 132*a* and 132*b* exerted onto the pivot shaft 114, the pivot shaft 114 is in electrical contact with the connecting members 130*a* and 130*b*, along the side surface of the pivot shaft 114 to provide a primary electrical connection, at any rotational position of the auxiliary plug 110. Accordingly, electrical blades 112 are electrically connected to connecting members 130*a* and 130*b*, during rotation of the auxiliary plug 110 at any position.

According to another embodiment, each of the connecting members 130*a* and 130*b* is further provided with a spring leaf 138*a* and 138*b*, as shown in FIGS. 4A to 4F. When the pivot shaft 114 is inserted into the spring bush 132*a* and 132*b*, spring leaf 138*a* and 138*b* bias against an end surface of the pivot shaft 114, providing a complementary electrical connection between the connecting members 130*a*, 130*b* and the pivot shaft 114. Spring leaves 138*a* and 138*b* therefore increase the reliability of the electrical contact between the electrical connection members and the shaft.

Figure 6A:
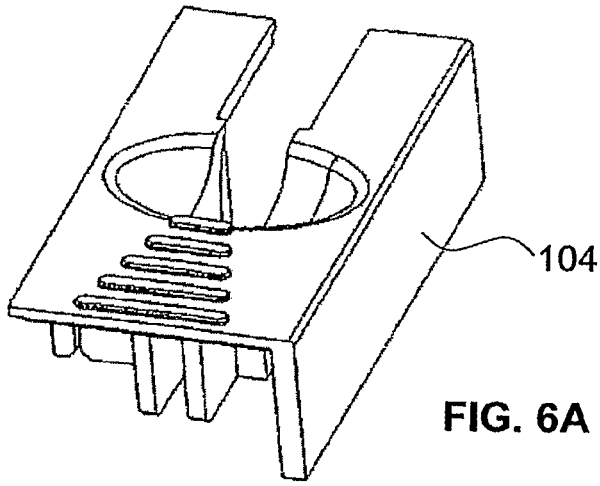
FIG. 6A is a perspective view of a top cover of a rotatable electrical plug connector shown in FIG. 1B.
Figure 6B:
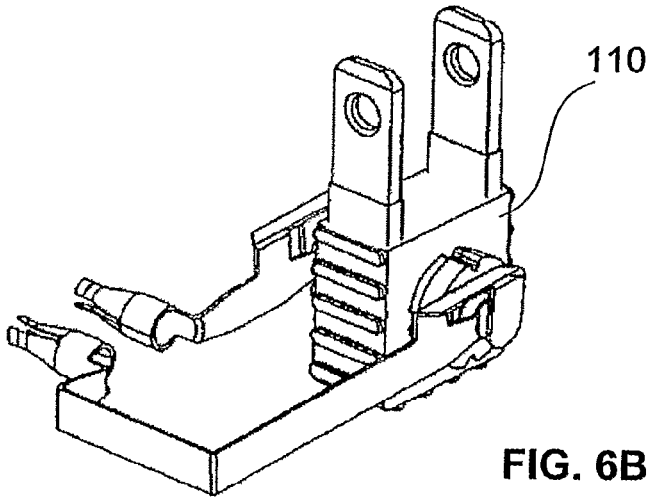
FIG. 6B is a perspective of the auxiliary body and electrical connection members of the rotatable electrical plug connector shown in FIG. 1B.
Figure 6C:
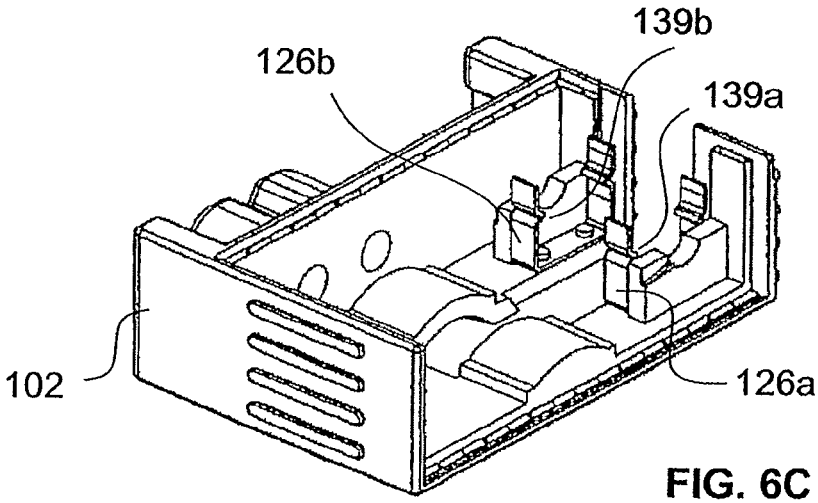
FIG. 6C is a perspective of the base member of the rotatable electrical plug connector shown in FIG. 1B.

As shown in FIGS. 6A, 6B and 6C, the auxiliary plug 110, assembled with the electrical connection members 130*a* and 130*b* can now be installed onto base 102 of the main body 120.

As mentioned above, the springs 126*a* and 126*b* are fixed to base 102. When the auxiliary plug 110 is installed onto the base 102, springs 126*a* and 126*b* act against notched rings 116*a* and 116*b*, respectively, and with the tip 139*a* and 139*b* engaged with one of the notches. By virtue of this arrangement, auxiliary plug 110 is prevented from free rotation, but can only be rotated by overcoming the spring force exerted by springs 126*a* and 126*b*, typically through an action of a user.

In one embodiment, four notches are provided in each of the notched rings by which, the auxiliary plug 110 can be fixed at 0°, 90°, 180° and 270° positions relative to the main body 120. It should be appreciated that notches other than four may be formed as alternatives, for example, 3, 5, 6 or other numbers, and with fixing angled other than 0°, 90°, 180° and 270°.

Figure 7:
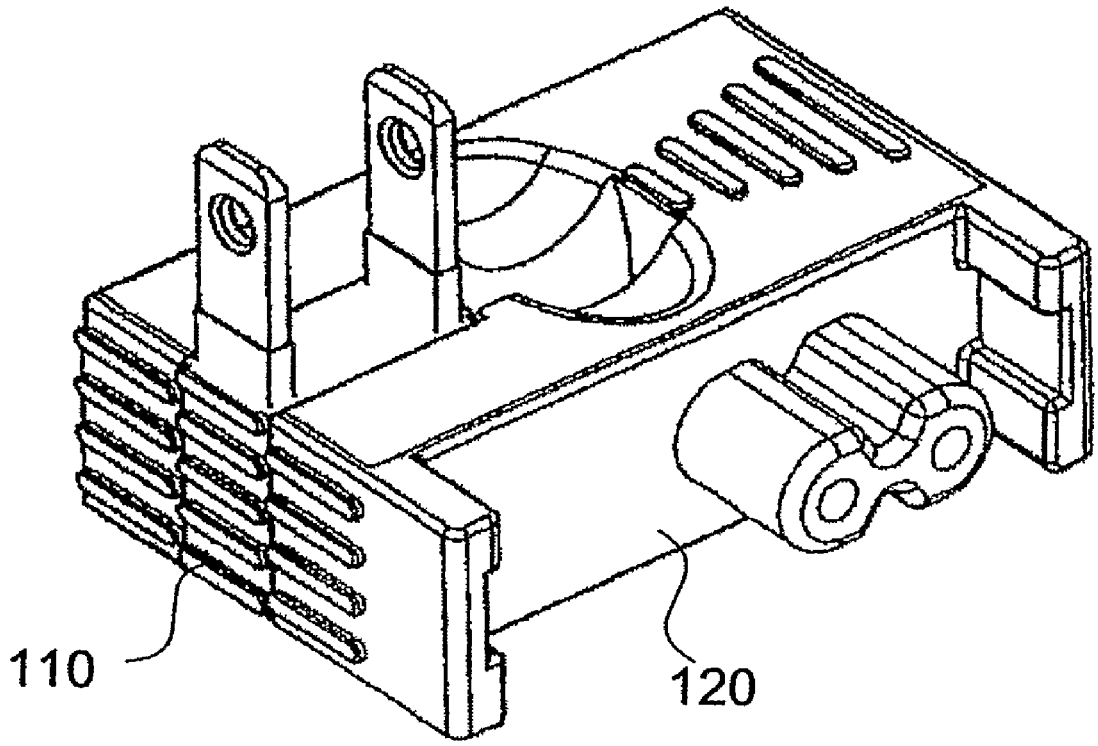
FIG. 7 is a perspective view of a rotatable electrical plug connector when the parts showing in FIGS. 6A, 6B and 6C are assembled together.

The auxiliary plug 110 is installed onto base 102, after the electrical connection member 130*b* is fixed to the auxiliary plug 110. The other electrical connection member 130*a* is then fixed to the base 102 and assembled with the auxiliary plug 110. Thereafter, the top cover 104 is capped to the base 102 to form the rotational electrical plug connector 100, as shown in FIG. 7.

Although embodiments of the present invention have been illustrated in conjunction with the accompanying drawings and described in the foregoing detailed description, it should be appreciated that the invention is not limited to the embodiments disclosed, and is capable of numerous rearrangements, modifications, alternatives and substitutions without departing from the spirit of the invention as set forth and recited by the following claims.

The invention claimed is:

1. An electrical connector comprising:

a main body having a set of electrical terminals formed thereon;

an auxiliary plug rotatably coupled to the main body by a pivot shaft formed by a pair of projections on said auxiliary plug that are electrically insulated from one another, and having a set of electrical blades formed thereon wherein each of the pair of projections are electrically connected to one of the set of electric blades;

electrical connection members disposed in the main body, and coupled to the electrical terminals and the electrical blades; and wherein the auxiliary plug is rotatable relative to the main body while maintaining electrical connections between the electrical terminals and the electrical blades, and each of the electrical connection members has a sleeve portion to engage with a side surface of one of the pair of projections to form a first electrical connection therebetween.

2. The electrical connector as recited in claim 1, wherein the sleeve portion forms a bush to support the pivot shaft.

3. The electrical connector as recited in claim 1, wherein the sleeve portion has slits partially separating the sleeve into two or more segments along a circular direction, wherein the two or more segments are biased against the side surface of the corresponding projection.

4. The electrical connector as recited in claim 1, wherein each of the electrical connection members is to engage with an end surface of one of the pair of projections to form a second electrical connection therebetween.

5. The electrical connector as recited in claim 4, wherein each of the electrical connection members has a spring leaf to engage with the end surface of one of the pair of projections.

6. The electrical connector as recited in claim 1, wherein the set of electrical blades are disposed in a blade plane and the pivot shaft is orthogonal to the blade plane.

7. The electrical connector as recited in claim 1, wherein the auxiliary plug is fixable to the main body at a predetermined position.

8. The electrical connector as recited in claim 7, further comprising a resilient member biased against the auxiliary plug for fixing the auxiliary plug at the predetermined position.

9. The electrical connector as recited in claim 8, wherein the auxiliary plug comprises a recess for engaging with the resilient member at which the auxiliary plug is locked at the predetermined position.

10. The electrical connector as recited in claim 9, wherein the auxiliary plug further comprises a plurality of recesses each for engaging with the resilient member at which the auxiliary plug is locked to the main body at a corresponding one of the plurality of predetermined positions.

11. The electrical connector as recited in claim 10, wherein when the auxiliary plug is locked to a first one of the plurality of predetermined positions, the set of electrical blades is received within the main body.

12. The electrical connector as recited in claim 10, wherein when the auxiliary plug is locked to a second one of the plurality of predetermined positions, the set of electrical blades is along a first angled direction perpendicular to a main plane of the main body.

13. The electrical connector as recited in claim 10, wherein when the auxiliary plug is locked to a third one of the plurality of predetermined positions, the set of electrical blades is parallel to a main plane of the main body.

14. The electrical connector as recited in claim 10, wherein when the auxiliary plug is locked to a fourth one of the plurality of predetermined positions, the set of electrical blades is along a second angled direction opposite to the first angled direction.

15. The electrical connector as recited in claim 1, wherein the auxiliary plug is disposed within the main body.

* * * * *